US008511466B1

(12) United States Patent
Harris

(10) Patent No.: US 8,511,466 B1
(45) Date of Patent: Aug. 20, 2013

(54) CLOTHING TRANSPORT DEVICE

(76) Inventor: Stanley H. Harris, Irving, TX (US)

( * ) Notice: Subject to any disclaimer, the term of this patent is extended or adjusted under 35 U.S.C. 154(b) by 0 days.

(21) Appl. No.: 11/413,814

(22) Filed: May 1, 2006

(51) Int. Cl.

| | |
|---|---|
| ***A45C 13/02*** | (2006.01) |
| ***A45C 13/10*** | (2006.01) |
| ***A45C 13/30*** | (2006.01) |
| *A45C 3/00* | (2006.01) |

(52) U.S. Cl.
USPC ..... 206/279; 206/290; 190/901

(58) Field of Classification Search
USPC ..... 206/279, 280, 287, 290, 291, 299, 206/278, 287.1, 283; 190/901; 229/87.15–87.17
See application file for complete search history.

(56) References Cited

U.S. PATENT DOCUMENTS

| | | | | | |
|---|---|---|---|---|---|
| 485,509 | A | * | 11/1892 | Speed | 206/287 |
| 841,902 | A | * | 1/1907 | Shumard | 190/107 |
| 1,610,966 | A | * | 12/1926 | Rike | 206/287 |
| 1,611,584 | A | * | 12/1926 | Farkash et al. | 206/287 |
| 1,754,663 | A | * | 4/1930 | Adams | 190/115 |
| 1,767,466 | A | * | 6/1930 | Le Montree | 206/280 |
| 1,967,584 | A | * | 7/1934 | McKenna | 229/87.06 |
| 2,175,387 | A | * | 10/1939 | Goding | 206/280 |
| 2,261,291 | A | | 11/1941 | Salavsky | |
| 2,626,689 | A | | 1/1953 | Davis et al. | |
| 3,024,824 | A | * | 3/1962 | Bass | 383/4 |
| 3,570,570 | A | * | 3/1971 | Winner | 294/137 |
| 3,737,013 | A | | 6/1973 | Powell | |
| D281,651 | S | | 12/1985 | Bomes et al. | |
| 4,801,010 | A | | 1/1989 | Levitas | |
| 4,881,684 | A | * | 11/1989 | Chinman | 190/115 |
| 5,060,795 | A | | 10/1991 | Bomes et al. | |
| 5,469,967 | A | | 11/1995 | Boorady | |
| 5,628,398 | A | * | 5/1997 | Jackson | 206/287.1 |
| 6,237,761 | B1 | * | 5/2001 | Godshaw et al. | 206/297 |

* cited by examiner

*Primary Examiner* — Sue A Weaver
(74) *Attorney, Agent, or Firm* — Carstens & Cahoon, LLP; Vincent J. Allen

(57) ABSTRACT

A clothing transport device including a panel having a length defined between a top edge and a bottom edge and a width defined between a first side edge and a second side edge. An interior surface of the panel receives clothing to be transported. A first portion of the panel is defined between the first side edge and the clothing. The first portion is foldable over the clothing. Each of a plurality of closing straps is coupled to the second side edge of the panel. Each of a plurality of closing buckles is coupled to the exterior surface of the panel. A second portion of the panel is defined between the second side edge and the clothing and is folded over the first portion to encase the clothing in the panel. The closing straps releasably engage the closing buckles to secure the second portion over the first portion.

18 Claims, 6 Drawing Sheets

CLOTHING TRANSPORT DEVICE

BACKGROUND OF THE INVENTION

1. Field of the Invention

The present invention relates to garment bags and more particularly pertains to a new garment bag for transporting clothing from one location to another while traveling or moving.

2. Description of the Prior Art

The use of garment bags is known in the prior art. U.S. Pat. No. 4,801,010 describes a device for serving as a portable wardrobe to contain clothing for a person that is traveling. Another type of garment bag is U.S. Pat. No. 5,060,795 for receiving and facilitating transporting of clothing with a person that is traveling. Another type of garment bag is U.S. Pat. No. 5,469,967 that is convertible to a duffel-type bag when the person does not need the clothing to be kept in a substantially flat and pressed state.

While these devices fulfill their respective, particular objectives and requirements, the need remains for a device that has certain improved features that allow a large amount of clothing to be contained and easily carried by one or more people when the clothing is being moved from one location to another such as during a person changing residences.

SUMMARY OF THE INVENTION

The present invention meets the needs presented above by generally comprising a panel having a length defined between a top edge and a bottom edge and a width defined between a first side edge and a second side edge. The panel has a thickness defined between an interior surface and an exterior surface. The interior surface receives clothing to be transported. A first portion of the panel is defined between the first side edge and the clothing. The first portion is foldable over the clothing. Each of a plurality of closing straps is coupled to the second side edge of the panel. Each of a plurality of closing buckles is coupled to the exterior surface of the panel. A second portion of the panel is defined between the second side edge and the clothing. The second portion is foldable over the first portion and the clothing to encase the clothing in the panel. Each of the closing straps releasably engages one of the closing buckles to secure the second portion over the first portion and the clothing.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
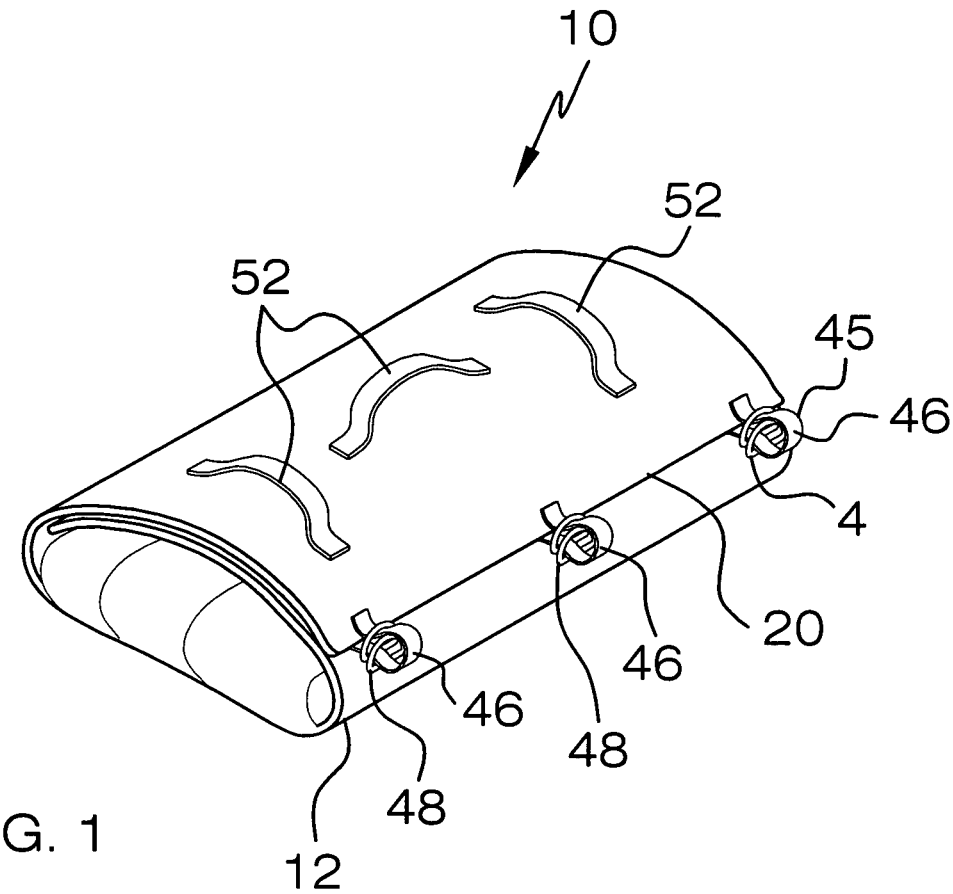
FIG. 1 is a perspective view of a clothing transport device according to the present invention in a wrapped state.
Figure 2:
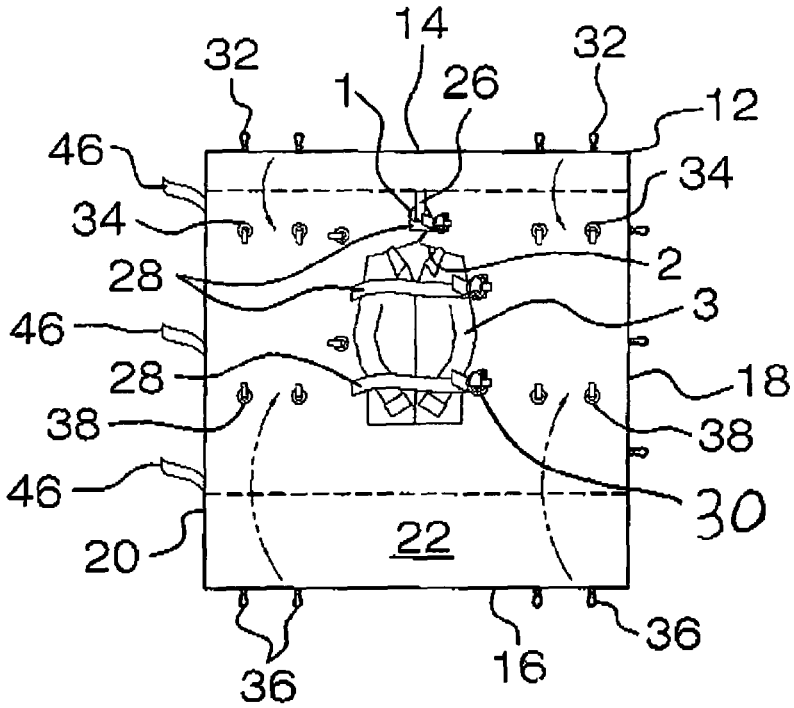
FIG. 2 is a top view of the present invention with the panel opened.
Figure 3:
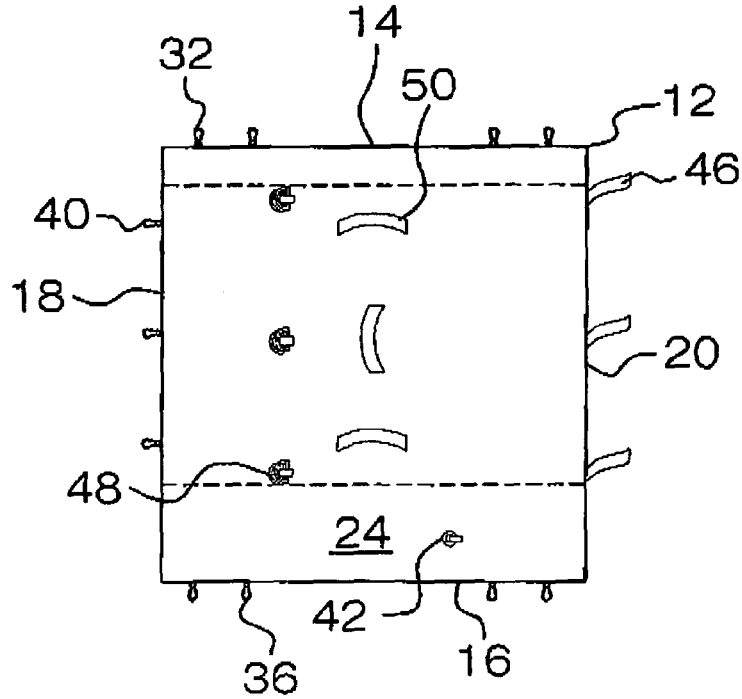
FIG. 3 is a bottom view of the present invention shown in FIG. 2.
Figure 4:
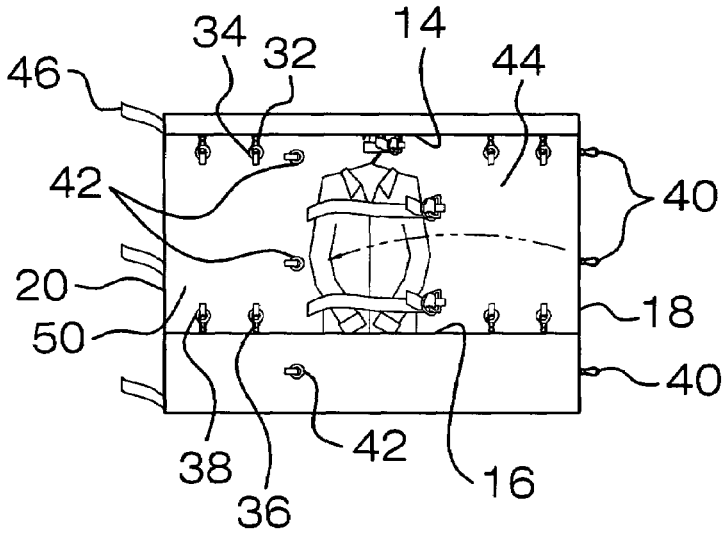
FIG. 4 is a top view of the present invention with the top edge and bottom edge positioned over the interior surface.
Figure 5:
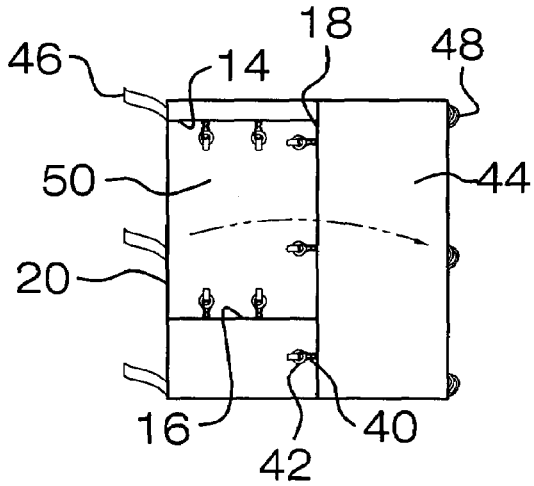
FIG. 5 is a top view of the present invention with the first portion folded over the interior surface.
Figure 6:
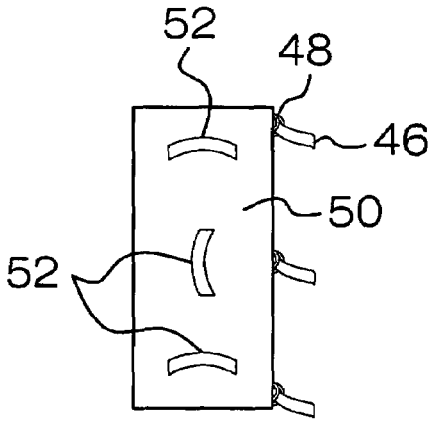
FIG. 6 is a top view of the present invention with the second portion folded over the first portion.
Figure 7:
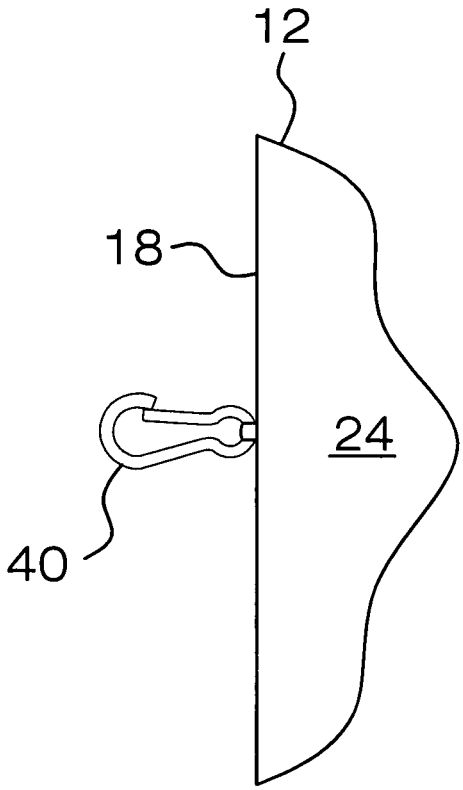
FIG. 7 is an enlarged top view of one of the clips of the present invention.

With reference now to the drawings, and in particular to FIGS. 1 through 10 thereof, a new garment bag embodying the principles and concepts of the present invention and generally designated by the reference numeral 10 will be described.

As best illustrated in FIGS. 1 through 10, the clothing 3 transport device 10 generally comprises a panel 12 having a length defined between a top edge 14 and a bottom edge 16 and a width defined between a first side edge 18 and a second side edge 20. The panel 12 has a thickness defined between an interior surface 22 and an exterior surface 24.

A hanger loop 26 is coupled to the interior surface 22 of the panel 12. The hanger loop 26 is configured for releasably engaging one or more hooks 1 each attached to an associated hanger 2 supporting clothing 3. Each of a plurality of securing straps 28 and each of a plurality of securing buckles 30 is coupled to the interior surface 22 of the panel 12. Each of the securing straps 28 is positioned for being extendable over the clothing 3 and engaging one of the securing buckles 30 to secure the clothing 3 and hangers 2 to the interior surface 22 of the panel 12. The securing buckles 30 are positioned about one third of width of the panel 12 from the first side edge 18 and the securing straps 28 are secured to the panel 12 about one third of the width from the second side edge 20 of the panel 12. One of the securing buckles 30 and one of the securing straps 28 are set closer together to accommodate the hooks 1 of the hangers 2.

Each of a plurality of upper clips 32 is coupled to the top edge 14 of the panel 12. Each of a plurality of upper rings 34 is coupled to the interior surface 22 of the panel 12. The panel 12 is folded to position the top edge 14 over the interior surface 22 and over a portion of the hangers 2. Each of the upper clips 32 is releasably engaged to one of the upper rings 34 to secure the top edge 14 over the interior surface 22 of the panel 12 and the one or more hooks 1. The upper rings 34 are substantially aligned with each other along a line orientated parallel to the top edge 14 and bottom edge 16 and extending through the hanger loop 26.

Each of a plurality of lower clips 36 is coupled to the bottom edge 16 of the panel 12. Each of a plurality of lower rings 38 is coupled to the interior surface 22 of the panel 12. The panel 12 is foldable to position the bottom edge 16 over the interior surface 22 and position the bottom edge 16 over a bottom portion of the clothing 3. Each of the lower clips 36 is releasably engaged to one of the lower rings 38 to secure the bottom edge 16 over the interior surface 22 and the bottom portion of the clothing 3. The lower rings 38 are substantially aligned with each other along a line orientated parallel to the top edge 14 and bottom edge 16 and being aligned with one of the securing straps 28 and one of the securing buckles 30 positioned closest to the bottom edge 16 of the panel 12.

Each of a plurality of edge clips 40 is coupled to the first side edge 18 of the panel 12. Each of a plurality of edge rings 42 is coupled to the panel 12. A first portion 44 of the panel 12 is defined between the first side edge 18 and the clothing 3. The first portion 44 is foldable over the clothing 3 and a portion of the top edge 14 and the bottom edge 16. Each of the edge clips 40 releasably engages one of the edge rings 42 to secure the first portion 44 of the panel 12 over the clothing 3. The edge rings 42 are substantially aligned with each other along a line orientated parallel to the first side edge 18 and second side edge 20 and being positioned about a third of the width of the panel 12 from the second side edge 20. One of the edge rings 42 is positioned on the exterior surface 24 of the panel 12 and is aligned with the edge rings 42 coupled to the interior surface 22 of the panel 12 when the bottom edge 16 is folded over the interior surface 22 of the panel 12.

A closing assembly 45 includes a plurality of closing straps 46 and a plurality of closing buckles 48. Each of the plurality of closing straps 46 is coupled to the second side edge 20 of the panel 12. Each of the plurality of closing buckles 48 is coupled to the exterior surface 24 of the panel 12. A second portion 50 of the panel 12 is defined between the second side edge 20 and the clothing 3. The second portion 50 is foldable over the first portion 44 and the clothing 3 to encase the clothing 3 and hangers 2 in the panel 12. Each of the closing straps 46 releasably engages one of the closing buckles 48 to secure the second portion 50 over the first portion 44 and the clothing 3. The closing buckles 48 are substantially aligned with each other along a line orientated parallel to the first side edge 18 and second side edge 20 and being positioned about a third of the width of the panel 12 from the first side edge 18.

Each a plurality of handles 52 is coupled to the exterior surface 24 of the panel 12 to facilitate lifting of the panel 12 and the clothing 3 when the panel 12 has been folded around the clothing 3. Each of the handles 52 is coupled to the second portion 50 of the panel 12. One of the handles 52 is aligned with length of the panel 12 and facilitates lifting of the panel 12 and the encased clothing 3 by a single person. Each of a pair of the handles 52 is aligned with the width of the panel 12. The handles 52 are spaced apart to allow the panel 12 and the encased clothing 3 to be picked up by more than one person.

Figure 8:
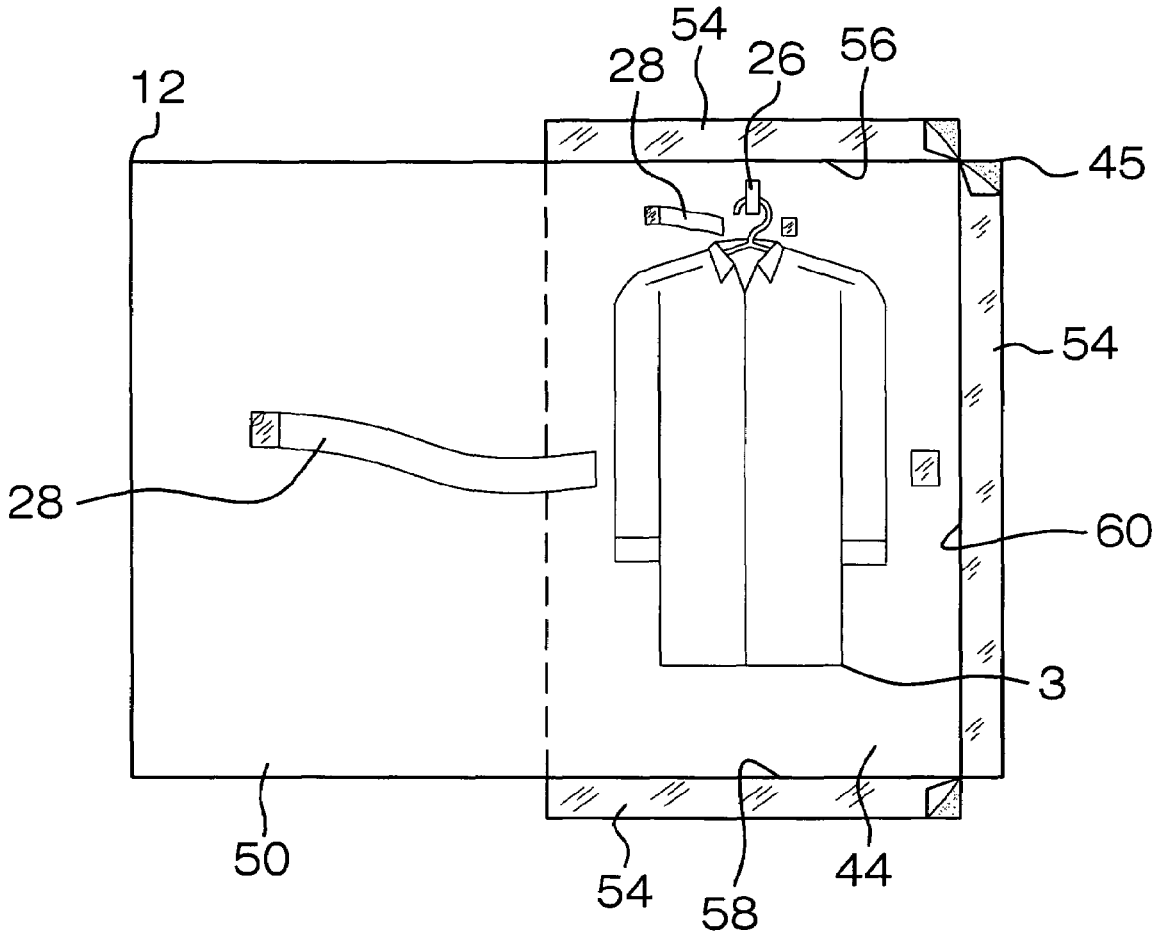
FIG. 8 is a top view of an embodiment of the present invention with the panel opened.
Figure 9:
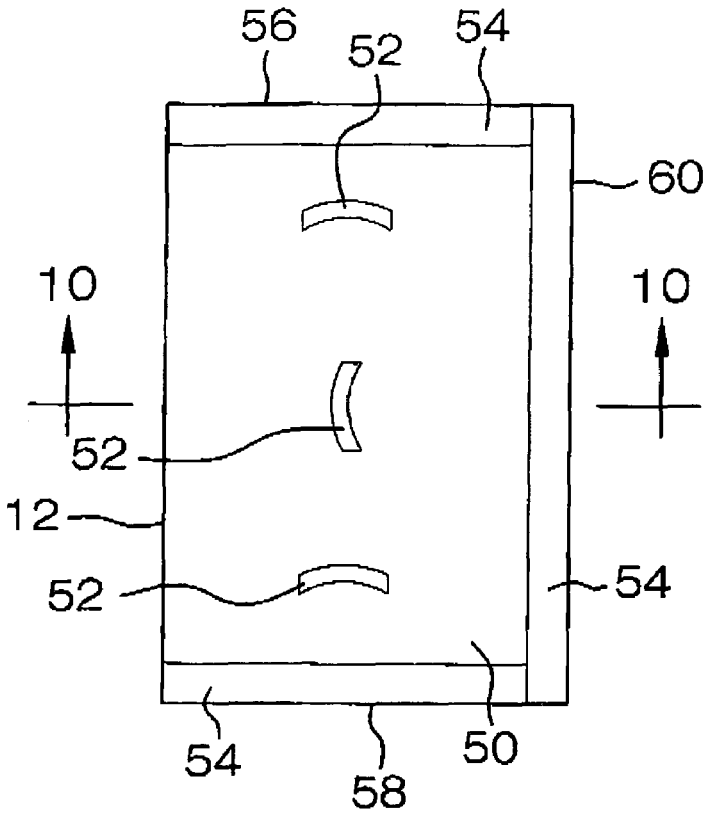
FIG. 9 is a top view of the embodiment of the present invention shown in FIG. 8 with the second portion folded over the first portion.
Figure 10:
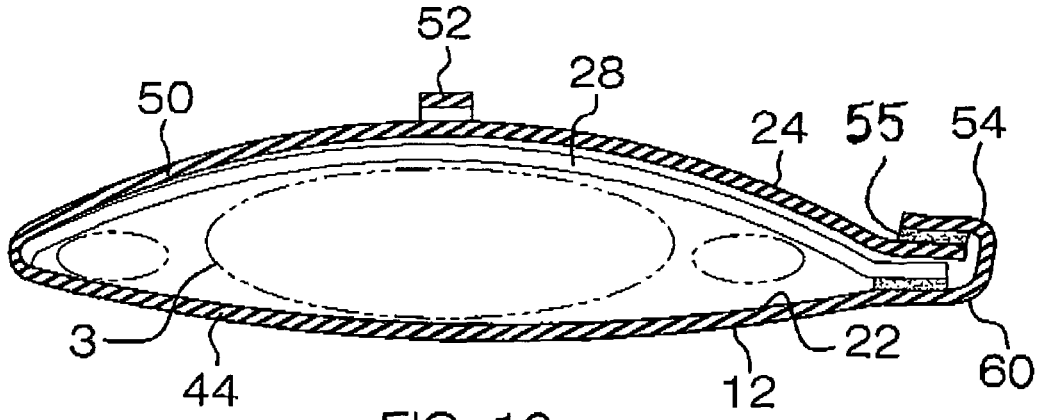
FIG. 10 is a cross-sectional view of the embodiment of the present invention taken along line 10-10 of FIG. 9.

In an embodiment, as shown in FIGS. 8 through 10, the securing strap 28 are extendable over the clothing 3 and releasably secured to the interior surface 22 of the panel 12 to maintain positioning of the clothing 3 on the first portion 44 of the panel 12. The second portion 50 is folded over the first portion 44 to position the clothing between the first portion 44 and the second portion 50. The closing assembly 45 includes a plurality of closure flaps 54 coupled to an upper edge 56, a lower edge 58 and a free edge 60 of said first portion 44. The closure flaps 54 are folded over the second portion 50 and adhesively secured to the exterior surface 24 of the second portion 50 by an adhesive 55 to secure the second portion 50 over the clothing 3. The panel 12 may be comprised of tear resistant material, such as a vinyl, to protect the clothing 3 and which can be readily disposed of when the clothing 3 has been removed.

In use, the hooks 1 of the hanger 2 are slipped into the hanger loop 26 and the clothing 3 extended towards the bottom edge 16 of the panel 12. The securing straps 28 are extended across the clothing 3 and the hangers 2 and engaged to the securing buckles 30 to secure the clothing 3 to the panel 12. The top edge 14 is then positioned over the interior surface 22 and the upper clips 32 are engaged to the upper rings 34. The bottom edge 16 is positioned over the interior surface 22 and the lower clips 36 are engaged to the lower rings 38. The first side edge 18 is positioned over the interior surface 22 so that the first portion 44 is positioned over the clothing 3 and the edge clips 40 are engaged to the edge rings 42. The second portion 50 of the panel 12 is folded over the first portion 44 and the closing straps 46 are engaged to the closing buckles 48 to secure the second portion 50 over the first portion 44 and secure the clothing 3 encased in the panel 12. The handles 52 are then used to lift and transport the panel 12 and the clothing 3 encased in the panel 12.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A clothing transport device for transporting clothing during a moving of the clothing from one location to another location, the device comprising:

a panel having a length defined between a top edge and a bottom edge and a width defined between a first side edge and a second side edge, said panel having a thickness defined between an interior surface and an exterior surface, said interior surface receiving the clothing to be transported, said panel including a first portion and a second portion, said second portion being folded over said first portion to wrap said panel around the clothing;

a hanger loop being coupled to said interior surface of said panel, said hanger loop configured for releasably engaging one or more hooks each attached to an associated hanger supporting the clothing;

a closing assembly being coupled to said panel, said closing assembly engaging said second portion to secure said second portion over said first portion said first portion of said panel is defined between said first side edge and the clothing, said first portion being foldable over the clothing;

a plurality of lower clips, each of said lower clips being coupled to said bottom edge of said panel; and a plurality of lower rings, each of said lower rings being coupled to said interior surface of said panel, said panel being foldable to position said bottom edge over said interior surface and position said bottom edge over a bottom portion of the clothing, each of said lower clips being releasably engaged to one of said lower rings to secure said bottom edge over said interior surface and the bottom portion of the clothing.

2. The device according to claim 1, wherein said closing assembly includes a plurality of closing straps and a plurality of closing buckles, each of said closing straps being coupled to said second side edge of said panel, each of said closing buckles being coupled to said exterior surface of said panel, said second portion of said panel being defined between said second side edge and the clothing, each of said closing straps releasably engaging one of said closing buckles to secure said second portion over said first portion and the clothing.

3. The device according to claim 1, further comprising a plurality of securing straps and a plurality of securing buckles, each of said securing straps and securing buckles being coupled to said interior surface of said panel, each of said securing straps being positioned for being extendable over the clothing and engaging one of said securing buckles to secure the clothing and hangers to said interior surface of said panel.

4. The device according to claim 1, further comprising a plurality of upper clips, each of said upper clips being coupled to said top edge of said panel, each of a plurality of upper rings being coupled to said interior surface of said panel, said panel being folded to position said top edge over said interior surface and over a portion of hangers supporting the clothing, each of said upper clips being releasably engaged to one of said upper rings to secure said top edge over said interior surface of said panel and the one or more hooks.

5. The device according to claim 4, wherein said upper rings are substantially aligned with each other along a line orientated parallel to said top edge and said bottom edge.

6. The device according to claim 1, further comprising a plurality of edge clips, each of said edge clips being coupled to said first side edge of said panel; and a plurality of edge rings, each of said edge rings being coupled to said panel, each of said edge clips releasably engaging one of said edge rings to secure the first portion of said panel over the clothing when said first portion is folded over the clothing.

7. The device according to claim 1, further comprising a plurality of handles, each of said handles being coupled to said exterior surface of said panel to facilitate lifting of said panel and the clothing when said panel has been folded around the clothing, each of said handles being coupled to said second portion of said panel.

8. The device according to claim 1, further comprising a plurality of securing straps being coupled to said interior surface of said panel and to said first portion of said panel, each of said securing straps being positioned for being extendable over the clothing and releasably engaging said first portion to secure the clothing to said first portion.

9. The device according to claim 8, wherein said closing assembly includes a plurality of closure flaps being coupled to an upper edge, a lower edge and a free edge of said first portion, said closure flaps being foldable over said second portion and adhesively secured said exterior surface of said panel to secure said second portion to said first portion and over the clothing.

10. A clothing transport device for transporting clothing during a moving of the clothing from one location to another location, the device comprising:

a panel having a length defined between a top edge and a bottom edge and a width defined between a first side edge and a second side edge, said panel having a thickness defined between an interior surface and an exterior surface;

a hanger loop being coupled to said interior surface of said panel, said hanger loop configured for releasably engaging one or more hooks each attached to an associated hanger supporting the clothing;

a plurality of securing straps and a plurality of securing buckles, each of said securing straps and securing buckles being coupled to said interior surface of said panel, each of said securing straps being positioned for being extendable over the clothing and engaging one of said securing buckles to secure the clothing and hangers to said interior surface of said panel;

a plurality of upper clips, each of said upper clips being coupled to said top edge of said panel, each of a plurality of upper rings being coupled to said interior surface of said panel, said panel being folded to position said top edge over said interior surface and over a portion of the hangers, each of said upper clips being releasably engaged to one of said upper rings to secure said top edge over said interior surface of said panel and the one or more hooks, said upper rings being substantially aligned with each other along a line orientated parallel to said top edge and said bottom edge and extending through said hanger loop;

a plurality of lower clips, each of said lower clips being coupled to said bottom edge of said panel;

a plurality of lower rings, each of said lower rings being coupled to said interior surface of said panel, said panel being foldable to position said bottom edge over said interior surface and position said bottom edge over a bottom portion of the clothing, each of said lower clips being releasably engaged to one of said lower rings to secure said bottom edge over said interior surface and the bottom portion of the clothing;

a plurality of edge clips, each of said edge clips being coupled to said first side edge of said panel;

a plurality of edge rings, each of said edge rings being coupled to said panel, a first portion of said panel being defined between said first side edge and the clothing, said first portion being foldable over the clothing and a portion of said top edge and said bottom edge, each of said edge clips releasably engaging one of said edge rings to secure the first portion of said panel over the clothing;

a plurality of closing straps, each of said closing straps being coupled to said second side edge of said panel;

a plurality of closing buckles, each of said closing buckles being coupled to said exterior surface of said panel, a second portion of said panel being defined between said second side edge and the clothing, said second portion being foldable over said first portion and the clothing to encase the clothing and hangers in the panel, each of said closing straps releasably engaging one of said closing buckles to secure said second portion over said first portion and the clothing; and a plurality of handles, each of said handles being coupled to said exterior surface of said panel to facilitate lifting of said panel and the clothing when said panel has been folded around the clothing, each of said handles being coupled to said second portion of said panel.

11. A clothing transport device for transporting clothing during a moving of the clothing from one location to another location, the device comprising:

a panel having a length defined between a top edge and a bottom edge and a width defined between a first side edge and a second side edge, said panel having a thickness defined between an interior surface and an exterior surface, said interior surface receiving the clothing to be transported, said panel including a first portion and a second portion, said second portion being folded over said first portion to wrap said panel around the clothing, said first portion of said panel is defined between said first side edge and the clothing, said first portion being foldable over the clothing;

a hanger loop being coupled to said interior surface of said panel, said hanger loop configured for releasably engaging one or more hooks each attached to an associated hanger supporting the clothing;

a closing assembly being coupled to said panel, said closing assembly engaging said second portion to secure said second portion over said first portion; and a plurality of edge clips, each of said edge clips being coupled to said first side edge of said panel; and a plurality of edge rings, each of said edge rings being coupled to said panel, each of said edge clips releasably engaging one of said edge rings to secure the first portion of said panel over the clothing when said first portion is folded over the clothing.

12. The device according to claim 11, wherein said closing assembly includes a plurality of closing straps and a plurality of closing buckles, each of said closing straps being coupled to said second side edge of said panel, each of said closing buckles being coupled to said exterior surface of said panel, said second portion of said panel being defined between said second side edge and the clothing, each of said closing straps releasably engaging one of said closing buckles to secure said second portion over said first portion and the clothing.

13. The device according to claim 11, further comprising a plurality of securing straps and a plurality of securing buckles, each of said securing straps and securing buckles being coupled to said interior surface of said panel, each of said securing straps being positioned for being extendable over the clothing and engaging one of said securing buckles to secure the clothing and hangers to said interior surface of said panel.

14. The device according to claim 11, further comprising a plurality of upper clips, each of said upper clips being coupled to said top edge of said panel, each of a plurality of upper rings being coupled to said interior surface of said panel, said panel being folded to position said top edge over said interior surface and over a portion of hangers supporting the clothing, each of said upper clips being releasably engaged to one of said upper rings to secure said top edge over said interior surface of said panel and the one or more hooks.

15. The device according to claim 14, wherein said upper rings are substantially aligned with each other along a line orientated parallel to said top edge and said bottom edge.

16. The device according to claim 11, further comprising a plurality of handles, each of said handles being coupled to said exterior surface of said panel to facilitate lifting of said panel and the clothing when said panel has been folded around the clothing, each of said handles being coupled to said second portion of said panel.

17. The device according to claim 11, further comprising a plurality of securing straps being coupled to said interior surface of said panel and to said first portion of said panel, each of said securing straps being positioned for being extendable over the clothing and releasably engaging said first portion to secure the clothing to said first portion.

18. The device according to claim 17, wherein said closing assembly includes a plurality of closure flaps being coupled to an upper edge, a lower edge and a free edge of said first portion, said closure flaps being foldable over said second portion and adhesively secured said exterior surface of said panel to secure said second portion to said first portion and over the clothing.

* * * * *